US006945622B2

(12) United States Patent
Sakurai

(10) Patent No.: US 6,945,622 B2
(45) Date of Patent: Sep. 20, 2005

(54) PRINTHEAD HAVING PROTECTION CIRCUIT, AND PRINTING APPARATUS USING THE PRINTHEAD

(75) Inventor: Masataka Sakurai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 10/227,830

(22) Filed: Aug. 27, 2002

(65) Prior Publication Data

US 2003/0043235 A1 Mar. 6, 2003

(30) Foreign Application Priority Data

Aug. 31, 2001 (JP) ..... 2001-264669

(51) Int. Cl.[7] ..... B41J 29/38
(52) U.S. Cl. ..... 347/5; 347/12
(58) Field of Search ..... 347/5, 9, 12, 57–59; 257/355, 356, 360

(56) References Cited

U.S. PATENT DOCUMENTS

| | | | | |
|---|---|---|---|---|
| 4,066,918 A | | 1/1978 | Heuner et al. | |
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,083,137 A | * | 1/1992 | Badyal et al. | 347/14 |
| 5,371,395 A | * | 12/1994 | Hawkins | 347/59 |
| 5,389,953 A | | 2/1995 | Agar et al. | |
| 6,302,504 B1 | * | 10/2001 | Imanaka et al. | 347/9 |

FOREIGN PATENT DOCUMENTS

| | | |
|---|---|---|
| JP | 63-56957 | 3/1988 |
| JP | 2-135774 | 5/1990 |
| JP | 7-76081 | 3/1995 |
| JP | 410138484 A * | 5/1998 |

* cited by examiner

*Primary Examiner*—Stephen D. Meier
*Assistant Examiner*—Julian D. Huffman
(74) *Attorney, Agent, or Firm*—Fitzpatrick, Cella, Harper & Scinto

(57) ABSTRACT

A printhead is provided with a protection circuit protecting the printing element, in order to achieve a high electrostatic tolerance, in particular, an improved tolerance to electric insulation breakdown in an interlayer film. The protection circuit is formed between a signal input pad of the printing element and an inverter connected to a driving circuit. The protection circuit includes two pairs of diodes. A resistance is provided between the two pairs of diodes. Each pair of diodes enables quick dissipation of a high-voltage electrostatic surge, applied to the printhead, to a power supply or base line having a large capacity. A printing apparatus employing the printhead is also provided.

11 Claims, 8 Drawing Sheets

PRINTHEAD HAVING PROTECTION CIRCUIT, AND PRINTING APPARATUS USING THE PRINTHEAD

FIELD OF THE INVENTION

This invention relates to a printhead and a printing apparatus using said printhead, and more particularly, to an inkjet printhead structured such that electrothermal transducers for generating heat energy necessary for discharging ink and a driving circuit driving the electrothermal transducers are formed on one substrate, and a printing apparatus employing said printhead.

BACKGROUND OF THE INVENTION

As a data output apparatus employed in, for instance, a word processor, personal computer, facsimile or the like, there is a printer which prints desired data, e.g., characters, images and so forth, on a sheet-type printing medium, e.g., paper, film or the like.

For a printing method for such a printer, various printing methods are known. Particularly, an inkjet printing method recently receives attention because of its capability to perform printing without contacting a printing medium such as paper, ease of color printing, and quiet printing operation. In general, such a printer widely adopts a serial printing method because of its low cost and ease of downsizing. According to the serial printing method, printing is performed by reciprocally scanning a carriage, including a printhead discharging ink in accordance with desired printing data, in a direction orthogonal to the printing medium conveyance direction.

Particularly in a thermal inkjet method employing a bubble generation of ink for discharging ink droplets, which is induced by thermal energy generated by sending an electric current to heaters contact with the ink for approximately several $\mu$ seconds, it is possible to form a large number of nozzles in the printhead at high density. Forming a large number of nozzles in the printhead is advantageous in terms of an improved printing speed.

However, in a printer employing a printhead which adopts the inkjet printing method, if a few number of nozzles among the large number of nozzles are found clogged or a wire to the heater is broken due to deterioration with age, ink droplet discharge cannot be performed. Such event interferes an image printing operation. In the event of finding such nozzle which is permanently unable to discharge ink droplets, conventionally the printhead is replaced to recover the normal printing operation of the printer. Depending on products, a user replaces such a damaged printhead. This facilitates the maintenance of the printer.

Furthermore, there is a printer, which uses a head cartridge integrally having a printhead and an ink tank, and allows replacement of the entire head cartridge when refilling ink. In such a head cartridge, although the running cost tends to be high, the printhead is kept in an excellent condition at all times. Considering that the running cost includes the cost of replacing a printhead, the replacement cost can be rewarded. In addition, the ability to perform high-quality printing with a suppressed occurrence frequency of a problem, e.g., a clogged nozzle due to deterioration with age and so forth, can be appreciated as an advantage.

FIG. 6 is a perspective view showing an example of a printing element unit integrated on a conventional printhead.

The printing element unit has a large number of nozzle orifices (discharge orifices) 402, including heaters, on a printing element base 401 formed with a semiconductor substrate. On the printing element base 401, although not shown in the drawing, heaters (electrothermal transducers) arranged at positions opposite to the discharge orifices and a driver circuit for sending an electric current to the heaters are arranged. Moreover, on the printing element base 401, a power supply terminal for supplying electric power to drive the driver circuit and a pad terminal 403 serving as a signal terminal are provided. In addition, on the printing element base 401, ink channels (not shown) for introducing ink to the nozzle orifices are provided.

The conventional printhead is structured to use one color of ink for one printing element unit, or use plural colors of ink to perform printing. Depending on a specification of a printer, the printhead may sometimes integrate a number of printing element units in accordance with the number of colors used in printing, e.g., three colors, four colors, or six colors. In a case where a printer, having a specification to perform printing with three colors of ink, employs a printing element which is structured to use one color of ink for one printing element unit, three printing element units are integrated to the printhead. In a case where a printer, having a specification to perform printing with six colors of ink, employs a printing element which is structured to use two colors of ink for one printing element unit, three printing element units are integrated to the printhead to enable six-color printing.

FIG. 7 is a schematic view of a printhead in which three of the printing element unit shown in FIG. 6 are arranged next to each other.

Referring to FIG. 7, reference numeral 501 denotes a supporting base formed with molded resin or the like for supporting the printing element, ink container and so on; 502, the printing element unit shown in FIG. 6; 503, an electric contact realized by wire bonding or the like for connecting the pad terminal of the printing element unit 502 to an external wiring; and 504, a flexible substrate.

The flexible substrate 504 is mounted on the supporting base 501, and electrically connected to a print substrate 506 through a folded portion 505. A plurality of head pads 507 are formed on the print substrate 506, and are electrically continuous with respective wirings of the flexible substrate 504 through wirings in the print substrate 506. The head pads 507 are provided to electrically connect with a printer main unit.

In the printing element unit 502, an electric circuit consisting of a transistor, diode, resistance and so on is formed inside a semiconductor substrate, serving as a base, by a semiconductor manufacturing process similar to a process of manufacturing an ordinary IC. Similar to the ordinary IC which has a low tolerance to static electricity, the printing element unit also has a low tolerance to static electricity.

An electrostatic tolerance, required by an ordinary IC, indicates a predetermined level of a static charge applied to a terminal, which does not cause a breakdown. The electrostatic tolerance is defined mostly with an electrostatic surge applied in a post-process of an IC production in mind, such as chip dicing from a wafer, package assembling, mounting an IC onto a substrate and so on. A generally required standard of the tolerance is, for instance, according to EIAJ standard, ±200 V at 200 pF and 0 Ω, or according to MIL standard, ±1.5 kV at 100 pF and 1.5 kΩ.

However, in the case of the printhead according to the present invention which is replaceable by a user, there might be a risk that a user who has not eliminated static electricity directly comes into contact with the electric contact (head pad) between the printhead and printer main unit. For this reason, the printhead requires a higher electrostatic tolerance than an ordinary IC.

The head pads of the printhead are electrically connected to the input pad of the printing element by a low-resistance wiring. In a case where the printing element incorporates a protection circuit similar to that of an ordinary IC, the printing element will have the same level of an electrostatic tolerance as that of the ordinary IC.

Inventors of this invention have experimentally manufactured a printhead with the use of a printing element incorporating a protection circuit similar to that of an ordinary IC, and performed an electrostatic test on the head pad of the printhead with an electrostatic surge caused by a human body in mind. As a result, the inventors have confirmed a breakdown of the printing element.

Particularly they have confirmed a high occurrence frequency of an electric insulation breakdown in an interlayer film, which consists of a silicon oxidized film and so on, disposed between the substrate and other wiring layers, in the neighborhood of the contact portion connecting a signal input pad of the printing element to a resistance portion that limits an electrostatic surge with a metal wiring. The cause thereof is in that, as the voltage suddenly increases in the pad terminal of the printing element due to the applied electrostatic surge, the potential of the diode provided subsequent to the pad terminal through a resistance portion has instantaneously exceeded the withstand voltage of the interlayer film before the surge is absorbed.

To improve the electrostatic tolerance, a countermeasure using a semiconductor manufacturing process may be considered. A withstand voltage of the interlayer film is substantially uniquely determined by the composition of the interlayer film, film nature, and film thickness. Therefore, countermeasures, such as changing the composition of the interlayer film, increasing the film thickness or the like, may improve the tolerance to a certain level.

However, in the thermal inkjet printhead which generates a bubble in ink by heating the heaters to discharge ink, increasing the film thickness of the interlayer film largely affects thermal conduction from the heaters to ink and ink discharge performance. For instance, the silicon oxidized film used as the interlayer film has a lower thermal conductivity than that of the silicon substrate constituting the base. If the film thickness of the interlayer film is increased, it becomes difficult for the heat generated by the heaters to transfer to the substrate, and ultimately a longer time is required for cooling the heaters.

The residual heat affects the subsequent bubble generation, and may cause printing quality deterioration such as a change of an ink-discharging amount. If printing is to be performed after sufficient cooling, a longer printing time is required due to the time necessary for cooling, and as a result, the printer performance deteriorates.

Furthermore, increasing the film thickness may cause disadvantages, such as a decline in a throughput of the film forming process in the semiconductor manufacturing process, or a negative influence on a device characteristic of the transistor or the like manufactured.

Furthermore, another countermeasure considered is to add a discrete device between the head pads of the printhead and printing element for anti-static electricity. However, because this countermeasure causes the increased number of components, it brings about disadvantages, such as an increased cost and size of the printhead.

SUMMARY OF THE INVENTION

Accordingly, it is an object of the present invention to provide a printhead achieving a high electrostatic tolerance required by a printhead without increasing the cost of a printing apparatus main unit or a printing element of the printhead and the size of the printhead, more particularly, to provide a printhead achieving an improved tolerance to a static electricity insulation breakdown in an interlayer film, which is characteristic to an electrostatic breakdown in a printhead, and a printing apparatus using said printhead.

According to one aspect of the present invention, the foregoing object is attained by providing a printhead including a printing element, comprising: an input terminal arranged to input a signal for driving the printing element; a driving circuit arranged to drive the printing element; a first resistance connected between the input terminal and the driving circuit; a first pair of diodes, arranged between the input terminal and the first resistance, including a first diode connecting the input terminal to a power supply potential and a second diode connecting the input terminal to a base potential; and a second pair of diodes, arranged between the first resistance and the driving circuit, including a third diode connecting the first resistance to the power supply potential and a fourth diode connecting the first resistance to the base potential, wherein one end of the first resistance is connected between the first diode and second diode, and the other end of the first resistance is connected between the third diode and fourth diode.

Moreover, the printhead may further comprise a second resistance connected between the second pair of diodes and the driving circuit, wherein one end of the second resistance is connected between the third diode and fourth diode, and the other end of the second resistance is connected to the driving circuit.

Note that an inverter circuit is preferably provided as an input circuit at the driving circuit side.

In accordance with the present invention as described above, a protection circuit protecting the printing element is formed between the signal input pad of the printing element and the driving circuit so as to quickly conduct a high-voltage electrostatic surge, which is applied to the input pad from the first protection function represented by the first and second diodes, to a power supply or a base line having a large capacity. In addition, by virtue of the first and second resistances, the internal circuit of the printing element is protected from an application of a high-voltage electrostatic surge. Furthermore, by virtue of the second protection function, represented by the third and fourth diodes, which is arranged between the second resistance and the inverter circuit constituting a part of the internal circuit, the high-voltage electrostatic surge is quickly conducted to the power supply or base line having a large capacity.

The aforementioned printhead is preferably an inkjet printhead which performs printing by discharging ink. The inkjet printhead preferably comprises an electrothermal transducer, which generates heat energy to be applied to ink, for discharging ink by utilizing the heat energy.

In this case, the printing element includes: an electrothermal transducer arranged on a base constructed with a semiconductor substrate; a nozzle discharging ink; and a driver circuit for sending an electric current to the electrothermal transducer to be driven, formed on the base.

According to the present invention, the foregoing object is attained by providing a printing apparatus performing printing by using the printhead having the above-described construction.

The invention is particularly advantageous since the printhead achieves an improved tolerance to a high-voltage electrostatic surge, which is applied when a user directly comes into contact with an electric contact (head pad) between the printhead and printer main unit in an attempt to remove the printhead from the printer main unit and replace it without eliminating a static charge. Particularly, it is possible to improve a tolerance to an electric insulation breakdown, caused by a high voltage, in an interlayer film which is formed on a semiconductor substrate of a printing element.

Furthermore, the present invention is advantageous since it is not necessary to add a discrete device or the like to an external portion of the printing element to improve the tolerance. Therefore, it is possible to avoid an increased production cost or size of a printhead.

Moreover, a printing apparatus which adopts the aforementioned printhead having an improved tolerance is capable of performing a high-quality printing with little printing error.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Brief Description of Apparatus Main Unit>

Figure 1:
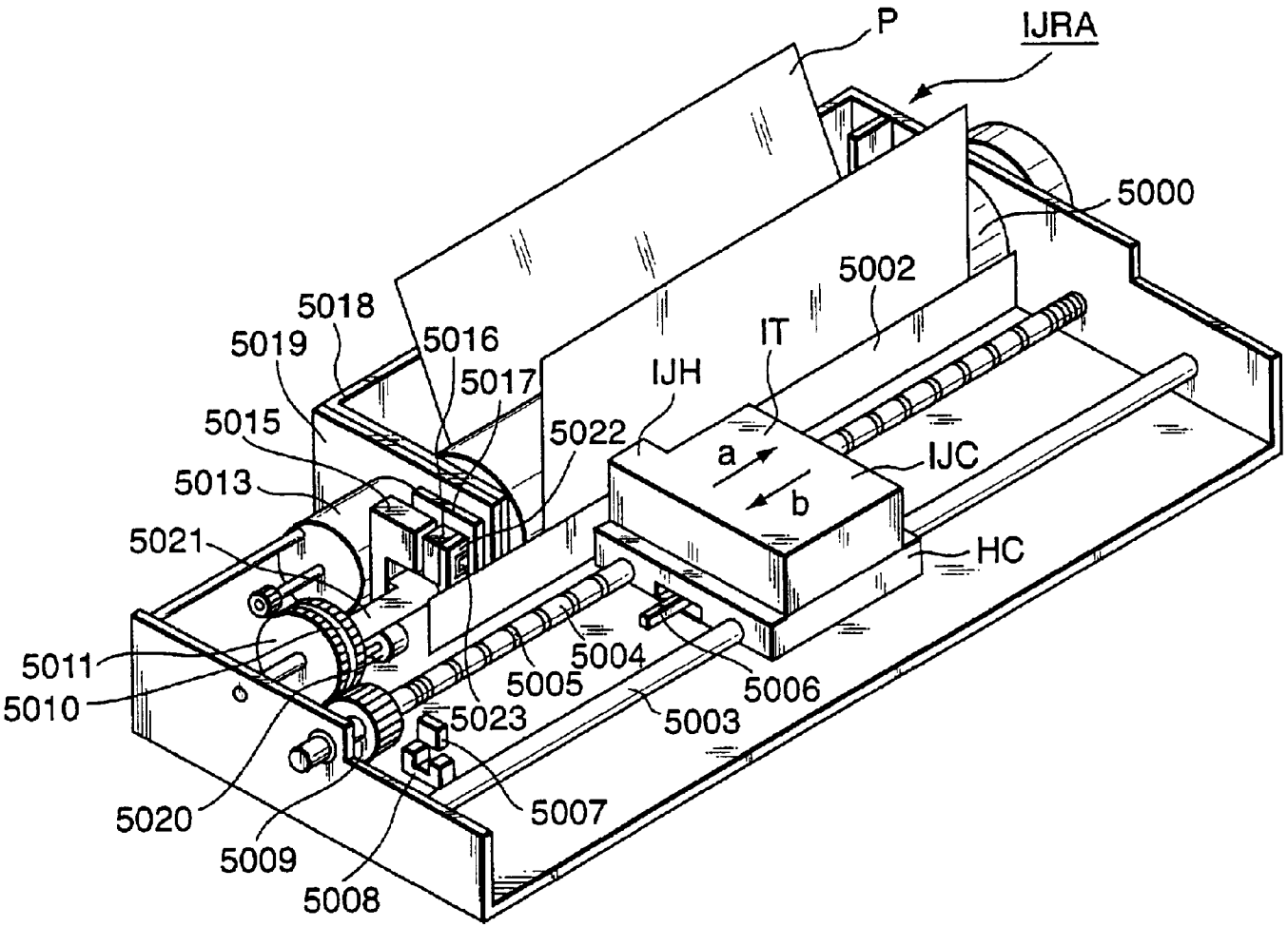
FIG. 1 is a perspective view showing an overall construction of a printing apparatus including a printhead as a typical embodiment of the present invention, which performs printing in accordance with an inkjet printing method.

FIG. 1 is a perspective view showing the outer appearance of an ink-jet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1 while being supported by a guide rail 5003. An integrated ink-jet cartridge IJC which incorporates a printhead IJH and an ink tank IT is mounted on the carriage HC. Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printhead IJH; and 5015, a suction device for sucking ink residue through the interior of the cap member. The suction device 5015 performs suction recovery of the printhead via an opening 5023 of the cap member 5015. Reference numeral 5017 denotes a cleaning blade; and 5019, a member which allows the blade to be movable in the back-and-forth direction of the blade. These members are supported by a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Note that the present invention may employ an ink cartridge where the printhead IJH and ink tank IT are separable. In any case, such a printhead or cartridge is removed and mounted by a user.

<Description of Control Circuit>

Hereinafter, description will be provided on the control circuit for executing print control of the above-described printer.

Figure 2:
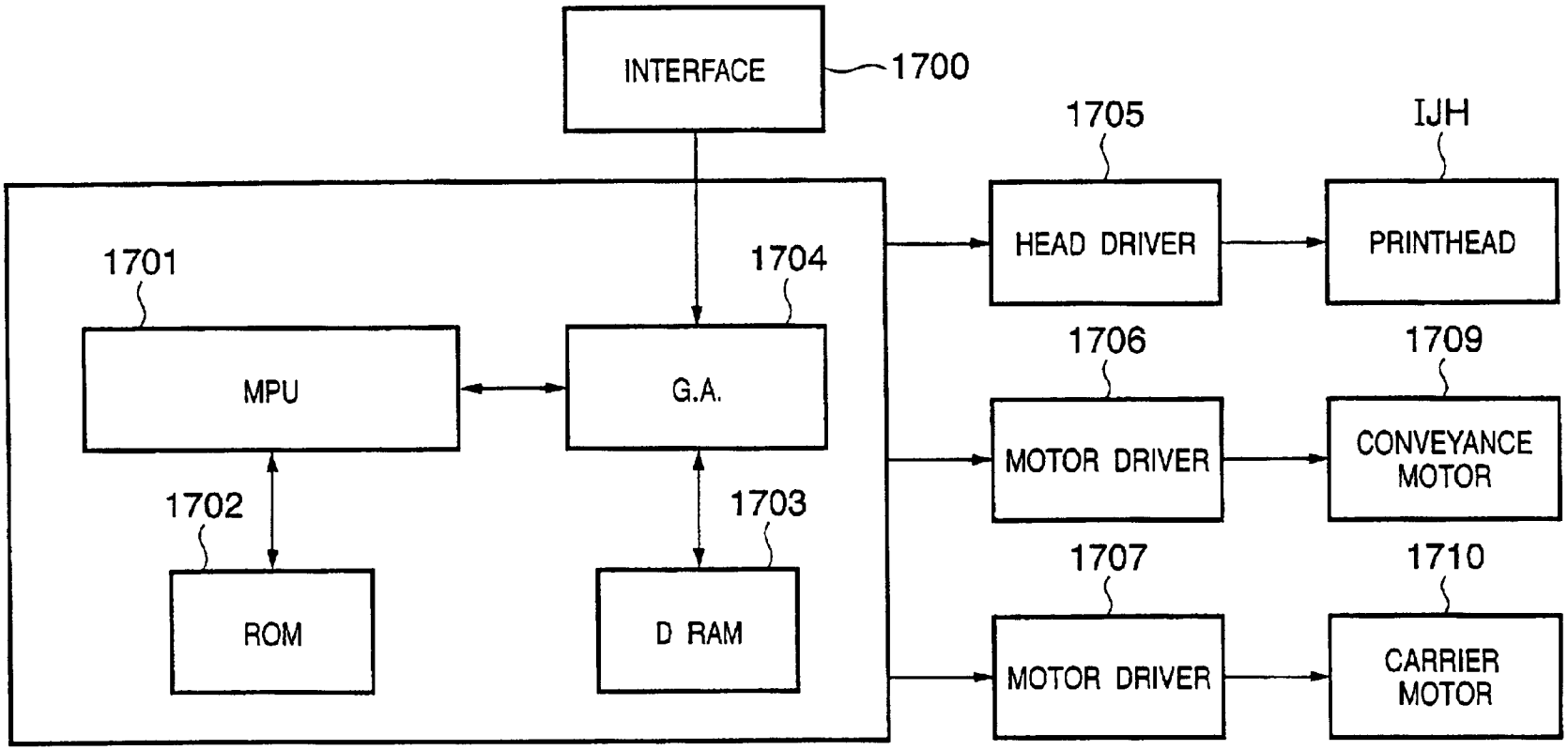
FIG. 2 is a block diagram showing an arrangement of a control circuit of the printing apparatus shown in FIG. 1.

FIG. 2 is a block diagram showing the arrangement of a control circuit of the ink-jet printer IJRA. Referring to FIG. 2 showing the control circuit, reference numeral 1700 denotes an interface for inputting to a printer main unit a printing signal outputted by, for instance, a personal computer controlling the printer main unit; 1701, an MPU; 1702, a ROM for storing a control program executed by the MPU 1701; and 1703, a DRAM for storing various data (aforementioned printing signals, or printing data supplied to the printhead IJH, and the like). Reference numeral 1704 denotes a gate array (G.A.) for performing supply control of printing data to the printhead IJH. The gate array 1704 also performs data transfer control among the interface 1700, MPU 1701, and DRAM 1703. Reference numeral 1710 denotes a carrier motor for conveying the printhead IJH; and 1709, a conveyance motor for conveying a printing sheet. Reference numeral 1705 denotes a head driver for driving the printhead IJH; and 1706 and 1707, motor drivers for driving the conveyance motor 1709 and the carrier motor 1710.

The operation of the aforementioned control structure is now described. When a printing signal is inputted to the interface 1700, the printing signal is converted to printing data by the gate array 1704 and MPU 1701 intercommunicating with each other. As the motor drivers 1706 and 1707 are driven, the printhead IJH is driven in accordance with the printing data transferred to the head driver 1705, thereby performing printing.

Figure 3:
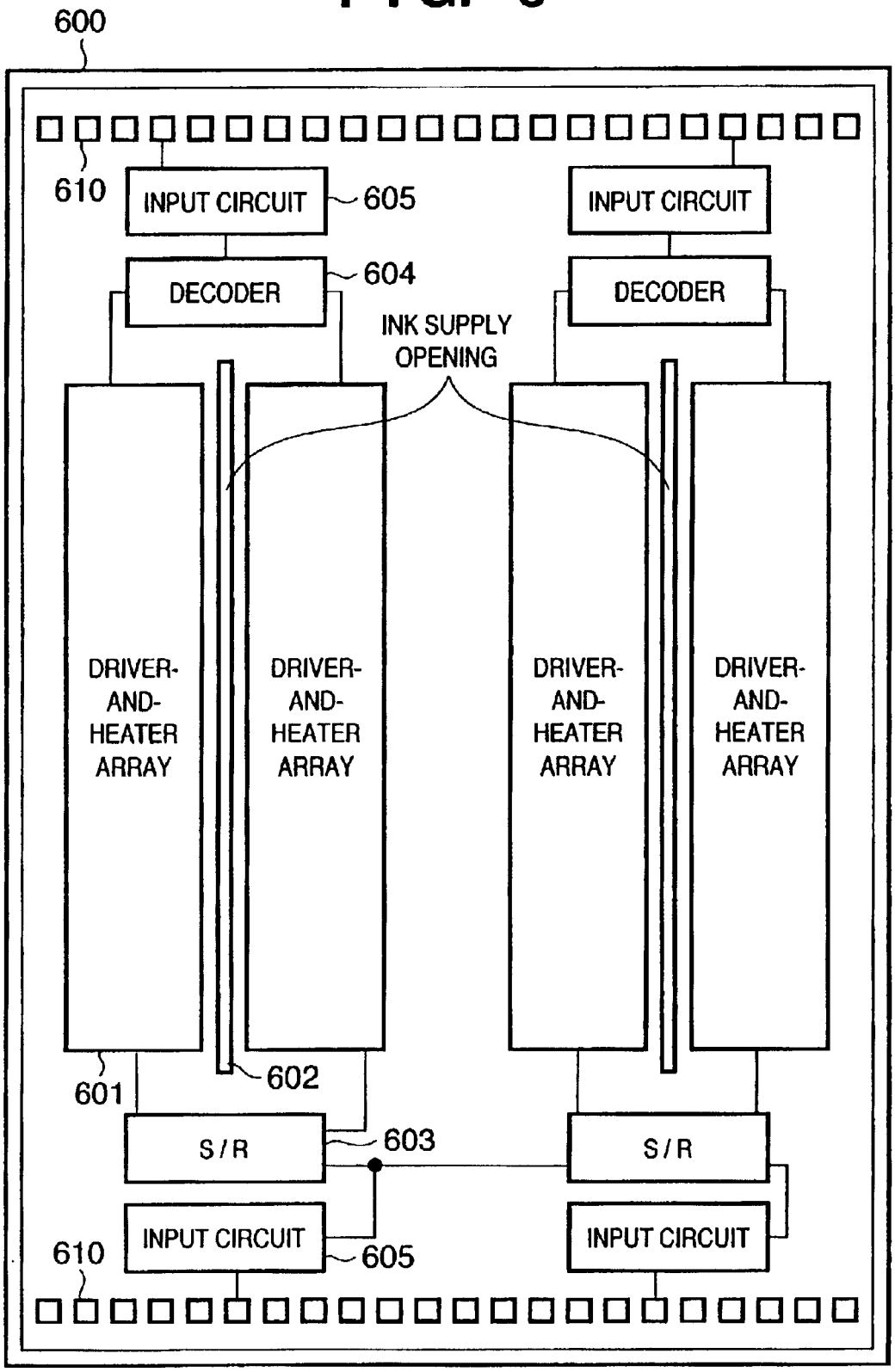
FIG. 3 is a block diagram showing a construction of an electric circuit of a printing element unit which constitutes a printhead IJH.
Figure 6:
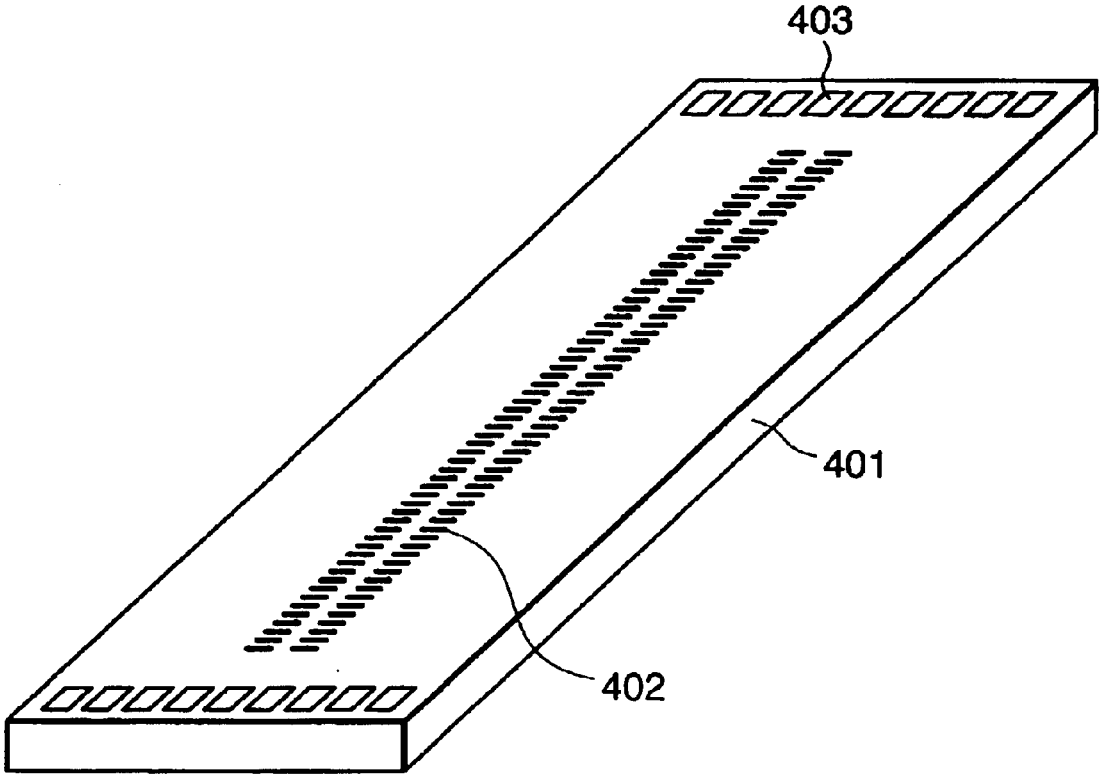
FIG. 6 PRIOR ART
FIG. 6 is a perspective view showing an example of a printing element unit integrated to a conventional printhead.
Figure 7:
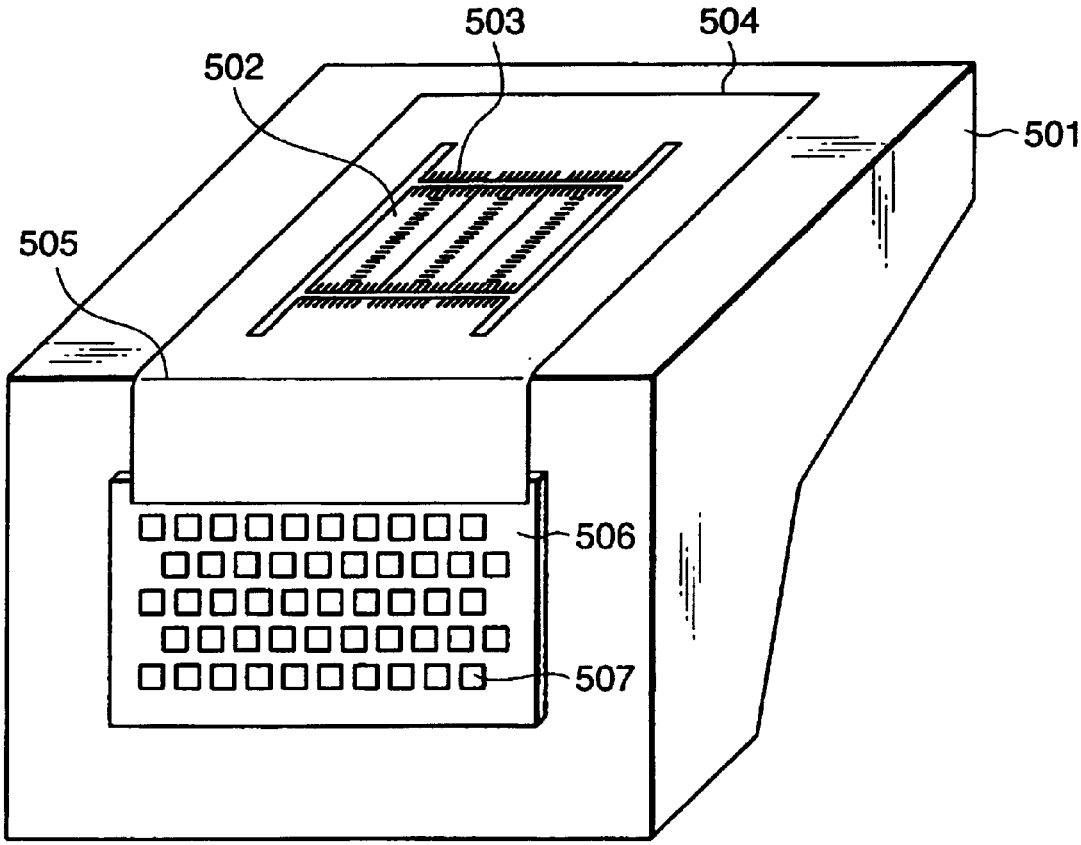
FIG. 7 PRIOR ART
FIG. 7 is a schematic view of a printhead in which three of the printing element unit shown in FIG. 6 are arranged next to each other.

FIG. 3 is a block diagram showing a construction of an electric circuit of a printing element unit which constitutes the printhead IJH. The printing element unit herein corresponds to the printing element unit described in the conventional art, which has a construction shown in FIG. 6.

Referring to FIG. 3, reference numeral 600 denotes a substrate integrally having heaters and driving circuits formed by a semiconductor process technique; 601, a heater-and-driving-circuit array where a plurality of heaters and driving circuits are arranged; 602, an ink supply opening for supplying ink from the back surface of the substrate 600; 603, a shift register (S/R) temporarily storing printing data to be printed; 604, a decoder for selecting a desired block of heaters from the heater-and-driving-circuit array 601 and driving the selected block of heaters; 605, an input circuit including a buffer circuit for inputting a digital signal to the shift register 603 and decoder 604; and 610, an input terminal.

In the printing element having the above-described circuit structure, an electrostatic protection circuit is provided to the input circuit 605 to protect the internal circuit from an electrostatic surge.

Hereinafter, the construction and operation of the electrostatic protection circuit are described in detail.

Note that the electrostatic protection circuit is formed on the same base as that of the semiconductor substrate, where the printing element and driving circuit thereof are formed, by a semiconductor manufacturing process.

Particularly, a signal input terminal having a high input impedance and a small input capacity is susceptible to a breakdown caused by an electrostatic surge. For such input terminal, an electrostatic protection circuit is provided in the path from the pad to the internal circuit so as to conduct an electrostatic surge to the power-supply or base line.

Prior to describing an electrostatic protection circuit according to this embodiment, an electrostatic protection circuit studied by the inventors to accomplish this invention is described.

Figure 8:
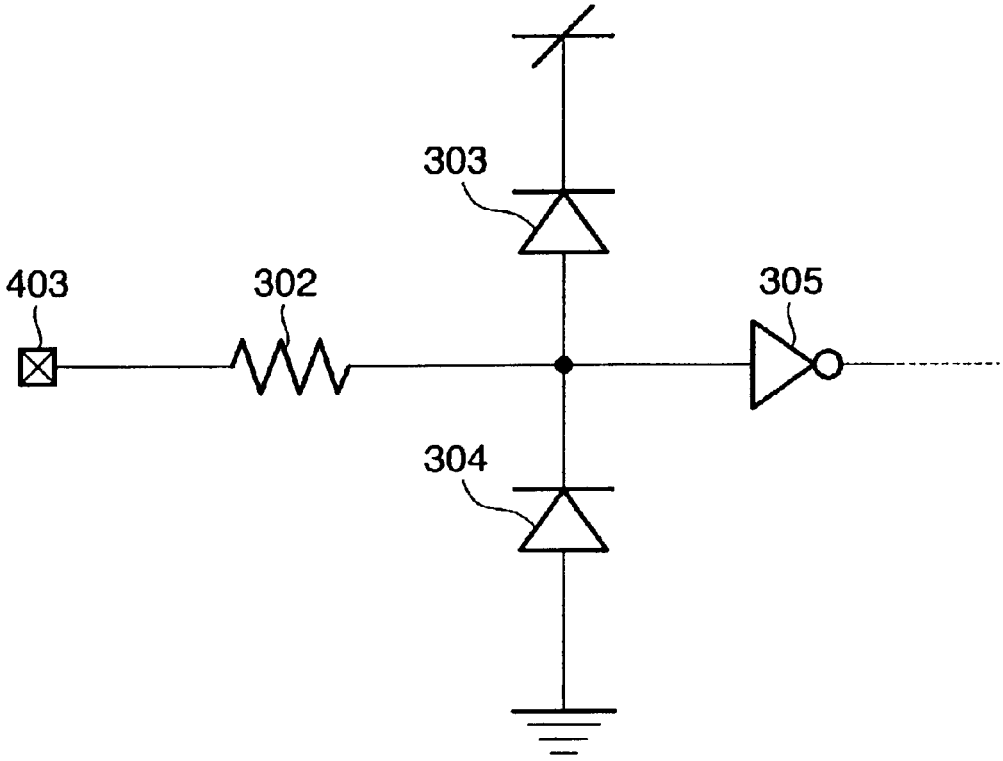
FIG. 8 is a circuit diagram showing an example of an electrostatic protection circuit.

FIG. 8 is a circuit diagram showing an example of an electrostatic protection circuit.

As shown in FIG. 8, a pad terminal 403 for inputting an electric signal to a printing element is connected to one end of a resistance 302 by a metal thin-film wiring or the like in the printing element. The resistance 302 is a thin-film resistance consisting of a polycrystalline silicon or a metallic compound or the like, or a diffused resistance formed by doping to the semiconductor substrate. The other end of the resistance 302 is wire-connected to an anode of a protection diode 303 and a cathode of a protection diode 304. The cathode and anode are respectively connected to a power supply potential and a base potential. Furthermore, the other end of the resistance 302 is connected to the internal circuit, in the example shown in FIG. 8, to an input of an inverter 305 of a logical circuit.

In the above-described circuit structure, when an electrostatic surge is inputted from the pad terminal 403 of the printing element, the surge flows from the pad side of the resistance 302 to the diodes 303 and 304 toward the direction to which the internal circuit is connected. If the electrostatic surge flowed in the resistance 302 has a potential higher than the power supply potential and base potential, the surge flows to the power supply potential through the diode, while if the surge has a potential lower than the power supply potential and base potential, the surge flows to the base potential through the diode. In other words, the diodes 303 and 304 serve as the elements that dissipate the surge potential.

Note if an electrostatic surge having a potential higher than a withstand voltage of the diode is applied, the rectification effect of the diode is limited.

By virtue of a current flowing the above-described path, a low voltage which is divided by the resistance 302, diodes 303 and 304 is applied to the input of the inverter 305 serving as the internal circuit, thereby achieving an effect of protecting the internal circuit from an electrostatic surge.

As described above, according to the study of the inventors of the present invention, it is clear that the printing element unit requires an electrostatic protection measure. However, since a printhead requires a higher electrostatic tolerance than an ordinary IC as mentioned above, it requires a further countermeasure against electrostatic surge.

In view of the above description, the present invention provides an electrostatic protection circuit which will be described in the following embodiments.

<First Embodiment>

Figure 4:
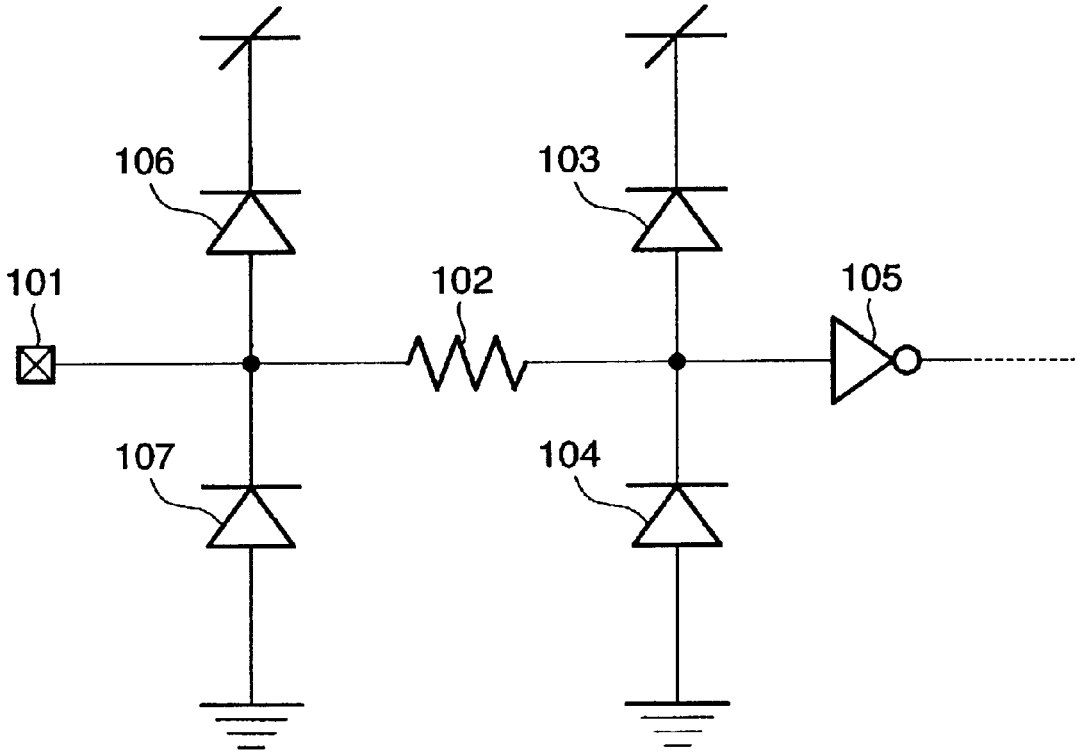
FIG. 4 is a circuit diagram showing a construction of a protection circuit of a printing element according to a first embodiment of the present invention.

FIG. 4 is a circuit diagram showing a construction of a protection circuit according to the first embodiment of the present invention.

It is apparent by comparing the construction shown in FIG. 4 with the construction shown in FIG. 8 that the protection circuit according to the first embodiment additionally comprises diodes 106 and 107, serving as a protection function element for dissipating a surge, between a terminal pad 101 (corresponding to the terminal pad 403 in FIG. 8) provided to input an electric signal for controlling and driving heaters that constitute the printing element discharging ink, and a resistance 102 (corresponding to the resistance 302 in FIG. 8).

In the construction shown in FIG. 4, the pad terminal 101 is connected to an anode of a diode 106 and a cathode of a diode 107 by a low-resistance wiring, such as a metal thin-film wiring in a printing element, and through these diodes connected respectively to the power supply potential and base potential.

As similar to the above-described circuit structure, the pad terminal 101 is connected to one end of the resistance 102 by a low-resistance wiring. The resistance 102 is a thin-film resistance consisting of a polycrystalline silicon or a metallic compound or the like, or a diffused resistance formed by doping to a semiconductor. The other end of the resistance 102 is connected to a power supply potential and a base potential through diodes 103 and 104. Further similar to the above-mentioned circuit, the other end of the resistance 102 is connected to the internal circuit such as a logical circuit. In the first embodiment, it is connected to an input of an inverter 105 of the logical circuit, and further electrically connected to a MOS gate (not shown) of the logic circuit.

By virtue of the above-described circuit structure, a sudden high-potential electrostatic surge inputted to the pad terminal 101 flows through the low-resistance wiring and is quickly conducted to the power supply potential and base potential through the diodes 106 and 107 serving as the first protection function element for dissipating the surge. Accordingly, it is possible to suppress an electric insulation breakdown in an interlayer film caused by an application of an instantaneous high voltage.

The electrostatic surge, which cannot be absorbed by the diodes 106 and 107, flows to the resistance 102. However, the potential of the electrostatic surge has already dropped to some extent by virtue of the diodes 106 and 107.

If the electrostatic surge flowed through the resistance 102 has a potential higher than the power supply potential or base potential, the surge flows to the power supply potential through the diode 103, while if the surge has a potential lower than the power supply potential or the base potential, the surge flows to the base potential through the diode 104. Herein, the diodes 103 and 104 serve as the second protection function element for dissipating the surge. Note in a case where a voltage applied is higher than a reverse withstand voltage of the diode, a current flows regardless of a rectification effect of the diode.

Herein, the potential, to which the input terminal of the inverter 105 is connected, is divided by the resistance 102, diodes 103 and 104. More specifically, the potential applied to the input terminal portion of the inverter 105 is a lowered potential because the current flows to the diodes in the forward direction and the potential from the power supply potential or base potential is divided by the diodes and resistance 102.

The above-described voltage control effect enables to protect the input circuit portion from a high-voltage electrostatic surge.

According to the above-described first embodiment, by further providing the protection function element which dissipates a surge between the pad terminal and resistance of the protection circuit for reducing a potential of the electrostatic surge flowed to the resistance to a certain level, even when a high-potential electrostatic surge is inputted, it is possible to protect the printing element from a breakdown by the electrostatic tolerance of the subsequent protection circuit.

Furthermore, by providing a protection circuit having a high tolerance to a high-potential electrostatic surge in a printing element, there is no need to change the semiconductor manufacturing process or separately add a discrete device as a protection device. Therefore, there are no disadvantages of the increased cost and size of the printhead.

<Second Embodiment>

Figure 5:
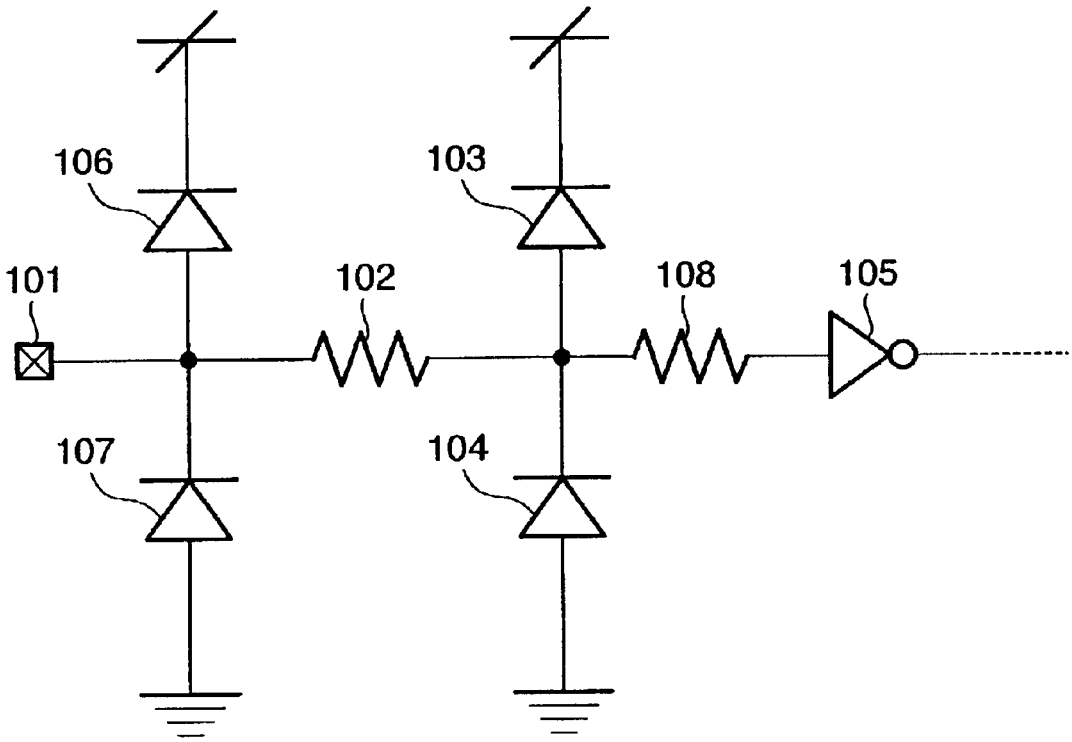
FIG. 5 is a circuit diagram showing a construction of a protection circuit of a printing element according to a second embodiment of the present invention.

FIG. 5 is a circuit diagram showing a construction of a protection circuit of a printing element according to the second embodiment of the present invention.

As is apparent from the comparison between the construction shown in FIG. 5 and the construction of the first embodiment shown in FIG. 4, in the protection circuit according to the second embodiment, that a resistance 108 is further added subsequent to the resistance 102. Note that since the construction in FIG. 5 is identical to the construction in FIG. 4 except the resistance 108, identical components are referred to by the same reference numerals and a detailed description thereof is omitted. Hereinafter, a characteristic operation effect, achieved by adding the resistance 108, is described.

An instantaneous high-voltage surge inputted to the pad terminal 101 is absorbed by the power supply potential and base potential through the diodes 106 and 107 serving as the first protection function element for dissipating the surge. Further, the surge component which cannot be absorbed herein flows through the resistance 102 to the diodes 103 and 104 serving as the second protection function element for dissipating the surge. Owing to the effect of surge absorption by the diodes 106 and 107, the instantaneous high potential of the surge flowed to the diodes 103 and 104 through the resistance 102 has dropped to a low-voltage that is more relaxed than the input surge applied to the pad terminal 101. Therefore, an electric insulation breakdown in the interlayer film on the pad terminal side of the resistance 102 mentioned in the first embodiment is suppressed.

Although the surge flowed to the diodes 103 and 104 has a low voltage which is relatively relaxed by virtue of the operation effect of the diodes 106 and 107, it is not relaxed enough for the withstand voltage of the input portion of the inverter 105. Particularly in a case where the input portion is constructed with a CMOS transistor employed in general, the input portion serves as a gate electrode of the MOS transistor. The gate electrode, provided opposite to the substrate, has as its insulating layer a thin oxidized film having approximately several hundred angstroms or smaller. Since the withstand voltage of the oxidized film is low, i.e., about several tens of volts, it is extremely susceptible to a breakdown caused by an application of an instantaneous surge.

Because of the above-described reason, the second embodiment is provided with the second resistance 108 between the diodes 103/104 and inverter 105 so as to further suppress instantaneous surge application to the gate constituting the inverter 105.

The electrostatic surge flowed to the resistance 102 tries to flow in three directions: the diodes 103, 104 and resistance 108. At the instant when the current starts flowing to the diodes, there is a slight delay because of the influence of a parasitic resistance and parasitic capacitance that exist in the diodes and wiring portions. The second resistance 108 of the second embodiment is provided with an intention to prevent a voltage from reaching the input terminal of the inverter 105 during this delay time, i.e., before the diodes starts conducting the voltage.

More specifically, a delay circuit is formed based on a parasitic capacitance (gate capacity of the MOS transistor) of the input terminal of the inverter 105 and the resistance 108. By virtue of the delay effect of this circuit, the surge applied to the input terminal of the inverter 105 is further relaxed, and a lowered surge voltage can be expected. Furthermore, by having a larger delay between the resistance 108 and inverter 105 due to the input capacitance than the delay of the surge conduction of the diodes 103 and 104, it is possible for the diodes to conduct the surge before the surge reaches the input portion of the inverter 105. Accordingly, a high-voltage surge is not applied to the input portion of the inverter 105. Therefore, further tolerance improvement can be achieved in the printing element having an input circuit such as a MOS gate electrode or the like.

According to the above-described second embodiment, by providing another resistance between the inverter and resistance, it is possible to further suppress an electrostatic surge, which could not be prevented sufficiently by the protection circuit of the first embodiment, and to provide a protection circuit having an improved tolerance to a high-voltage electrostatic surge caused by a human body or the like.

More specifically, the first protection function element constructed with a pair of diodes, arranged between the terminal pad of the protection circuit and the subsequent resistance, is employed to dissipate an electrostatic surge through a signal line with a low impedance, and the second protection function element constructed with a resistance and a pair of diodes, arranged subsequent to the diodes of the first protection function element, utilizes its voltage drop effect to protect the internal circuit from an electrostatic surge component that could not be absorbed sufficiently by the first protection function element. Furthermore, the delay effect of the quasi-RC circuit, formed with an inverter's parasitic capacitance and the second resistance, contributes to relax the change in a potential, applied to the input terminal of the inverter, which is caused by the surge.

Note in the foregoing embodiments, although two pairs of protection function elements (two pairs of diodes) are provided in the protection circuit, the present invention is not limited to this, but three pairs or more protection function elements may be provided.

Furthermore, although the foregoing embodiments have described that one protection function element provided in the protection circuit is a pair of diodes: one provided on a power supply potential side and the other provided on the base potential side, the number of diodes provided is not limited to this, but plural numbers of diodes may be provided. In addition, a different number of diodes may be provided to the power supply potential side and base potential side.

Moreover, since the capability to dissipate a surge through diodes depends upon the size of a PN junction of each diode, the diode on the potential side and the diode on the ground side may have a different size of the PN junction. The size of the PN junction is larger the better since the amount of electric charge that can be flowed per unit time increases. However, if the size is too large, a response to a signal inputted to the terminal decreases. Therefore, the size of the PN junction that does not deteriorate the response characteristic is preferable.

Furthermore, one of the diodes in the first protection function element may be omitted although the protection ability declines.

Note that, in the description of the above embodiment, a liquid droplet discharged from the printhead is ink, and the liquid stored in the ink tank is also ink. However, the liquid stored in the ink tank is not limited to ink. For example, the ink tank may store a processed liquid to be discharged onto a print medium so as to improve fixability and water repellency of a printed image or to improve its image quality.

Each of the embodiments described above comprises means (e.g., an electrothermal transducer) for generating heat energy as energy utilized upon execution of ink discharge, and adopts the method which causes a change in the state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

In addition, the present invention may employ not only a cartridge type printhead, in which an ink tank is integrally arranged on the printhead itself, but also an exchangeable chip type printhead which can be electrically connected to the apparatus main unit and can receive ink from the apparatus main unit upon being mounted on the apparatus main unit.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

In addition, the ink-jet printer of the present invention may be used in the form of a copying machine combined with a reader, and the like, or a facsimile apparatus having a transmission/reception function, in addition to an integrally-provided or stand-alone image output terminal of an information processing equipment such as a computer.

Note that the present invention can be applied to a system constituted by a plurality of devices (e.g., host computer, interface, reader, printer) or to an apparatus comprising a single device (e.g., copying machine, facsimile machine).

As many apparently widely different embodiments of the present invention can be made without departing from the spirit and scope thereof, it is to be understood that the invention is not limited to the specific embodiments thereof except as defined in the claims.

What is claimed is:

1. A printhead including a plurality of printing elements, comprising:

an input terminal arranged to input a signal for dividing the plurality of printing elements into a plurality of groups and divisionally driving the plurality of printing elements;

an input circuit arranged to input the signal from said input terminal;

a decoder arranged to receive the signal from said input circuit and drive the plurality of printing elements in units of the groups;

a first resistance connected between said input terminal and said input circuit;

a first pair of diodes, arranged between said input terminal and said first resistance, including a first diode connecting said input terminal to a power supply potential and a second diode connecting said input terminal to a base potential; and a second pair of diodes, arranged between said first resistance and said input circuit, including a third diode connecting said first resistance to the power supply potential and a fourth diode connecting said first resistance to the base potential, wherein one end of said first resistance is connected between said first diode and said second diode, and the other end of said first resistance is connected between said third diode and said fourth diode.

2. The printhead according to claim 1, further comprising a second resistance connected between said second pair of diodes and said input circuit, wherein one end of said second resistance is connected between said third diode and said fourth diode, and the other end of said second resistance is connected to said input circuit.

3. The printhead according to claim 1, wherein said input circuit comprises an inverter circuit.

4. The printhead according to claim 1, wherein said printhead is an inkjet printhead, which performs printing by discharging ink.

5. The printhead according to claim 4, wherein said inkjet printhead comprises a plurality of electrothermal transducers, which generate heat energy to be applied to the ink, for discharging the ink.

6. The printhead according to claim 5, wherein each one of said printing element includes:

one of said plurality of electrothermal transducers, arranged on a base constructed with a semiconductor substrate;

a nozzle for discharging the ink; and a driving circuit, formed on said base, for sending an electric current to said electrothermal transducer.

7. A printing apparatus for performing printing by using the printhead as claimed in any one of claims 1 to 6.

8. A printhead including a plurality of printing elements, comprising:

an input terminal arranged to input a signal for dividing the plurality of printing elements into a plurality of groups and divisionally driving the plurality of printing elements; and a decoder arranged to receive the signal from said input terminal and drive the plurality of printing elements in units of the groups based on the signal inputted from said input terminal, wherein, between said input terminal and said decoder, a first protection function element, a resistance, and a second protection function element are arranged in that order.

9. The printhead according to claim 8, wherein said first and second protection function elements are constructed with first and second diodes, respectively.

10. A circuit element board adapted to a printhead including a plurality of printing elements, comprising:

an input terminal arranged to input a signal for dividing the plurality of printing elements into a plurality of groups and divisionally driving the plurality of printing elements;

an input circuit arranged to input the signal from said input terminal;

a decoder arranged to receive the signal from said input circuit and drive the plurality of printing elements in units of the groups;

a first resistance connected between said input terminal and said input circuit;

a first pair of diodes, arranged between said input terminal and said first resistance, including a first diode connecting said input terminal to a power supply potential and a second diode connecting said input terminal to a base potential; and a second pair of diodes, arranged between said first resistance and said input circuit, including a third diode connecting said first resistance to the power supply potential and a fourth diode connecting said first resistance to the base potential, wherein one end of said first resistance is connected between said first diode and said second diode, and the other end of said first resistance is connected between said third diode and said fourth diode.

11. A circuit element board adapted to a printhead including a plurality of printing elements, comprising:

an input terminal arranged to input a signal for dividing the plurality of printing elements into a plurality of groups and divisionally driving the plurality of printing elements; and a decoder arranged to receive the signal from said input terminal and drive the plurality of printing elements in units of the groups based on the signal inputted from said input terminal, wherein, between said input terminal and said decoder, a first protection function element, a resistance, and a second protection function element are arranged in that order.

* * * * *

UNITED STATES PATENT AND TRADEMARK OFFICE

CERTIFICATE OF CORRECTION

PATENT NO. : 6,945,622 B2
DATED : September 20, 2005
INVENTOR(S) : Masataka Sakurai It is certified that error appears in the above-identified patent and that said Letters Patent is hereby corrected as shown below:

Title page,
Item [57], ABSTRACT,
Line 3, “tolerance” should read -- resistance --.

Signed and Sealed this

Thirty-first Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,945,622 B2
APPLICATION NO. : 10/227830
DATED : September 20, 2005
INVENTOR(S) : Masataka Sakurai It is certified that error appears in the above-identified patent and that said Letters Patent is hereby corrected as shown below:

ON THE TITLE PAGE
(Item 56), FOREIGN PATENT DOCUMENTS, "JP 410138484 A" should read --JP 10-34898 A--.

COLUMN 13 CLAIM 1
Line 29, "element" should read --elements--.

Signed and Sealed this

Twentieth Day of May, 2008

JON W. DUDAS
*Director of the United States Patent and Trademark Office*